US007059623B1

(12) United States Patent
Yeh

(10) Patent No.: US 7,059,623 B1
(45) Date of Patent: Jun. 13, 2006

(54) SLIDER WITH BRAKE PLATE

(76) Inventor: Tzong In Yeh, 4566 Crestwood St., Fremont, CA (US) 94538

( * ) Notice: Subject to any disclaimer, the term of this patent is extended or adjusted under 35 U.S.C. 154(b) by 0 days.

(21) Appl. No.: 11/108,451

(22) Filed: Apr. 18, 2005

(30) Foreign Application Priority Data

Nov. 26, 2004 (TW) ..... 93219111 U

(51) Int. Cl.
*A63C 7/10* (2006.01)

(52) U.S. Cl. ..... 280/605; 280/604; 280/809; 280/28.11

(58) Field of Classification Search ..... 280/605, 280/604, 28.11, 809, 816; 188/8, 128
See application file for complete search history.

(56) References Cited

U.S. PATENT DOCUMENTS 2,302,478 A * 11/1942 Snow ..... 280/605
2,781,200 A * 2/1957 Robison ..... 280/826
4,152,007 A * 5/1979 Smith ..... 280/605
4,234,207 A * 11/1980 De Vigili ..... 280/605
4,288,092 A * 9/1981 Mukri ..... 280/605
4,690,423 A * 9/1987 DeVigili ..... 280/605
5,509,683 A * 4/1996 Daniel ..... 280/605
5,553,403 A * 9/1996 McManus ..... 36/124
5,673,772 A * 10/1997 Martin ..... 188/6

* cited by examiner

*Primary Examiner*—J. Allen Shriver
(74) *Attorney, Agent, or Firm*—Rosenberg, Klein & Lee

(57) ABSTRACT

A slider includes a main board movable on a snow ground, and a brake plate mounted on the main board and protruding outward from the main board to face the snow ground. The brake plate is formed with a shovel portion extended toward the snow ground. Thus, the shovel portion of the brake plate is inserted into the snow ground to provide a braking effect to the main board.

4 Claims, 16 Drawing Sheets

SLIDER WITH BRAKE PLATE

BACKGROUND OF THE INVENTION

1. Field of the Invention

The present invention relates to a slider, and more particularly to a slider having a brake plate.

2. Description of the Related Art

A conventional slider has a braking effect that is achieved by a sharp turning action of the slider, so that the braking effect of the conventional slider is limited by the skiing field and the skiing skill of the user.

A conventional brake device for a slider in accordance with the prior art was disclosed in the Taiwanese Patent Publication No. 530682 and 595564 and comprises a flat plate mounted on the slider. The face of the flat plate has an inclined angle of about 45 degrees relative to the snow ground so that the flat plate rubs the snow ground to provide a braking effect. However, when the flat plate presses the snow ground, the flat plate easily slips on the snow ground, thereby decreasing the braking effect.

SUMMARY OF THE INVENTION

The primary objective of the present invention is to provide a slider with a brake plate, wherein the user can control the brake plate to brake the slider easily and conveniently.

A further objective of the present invention is to provide a slider with a brake plate, wherein the brake plate has a smaller folded volume, thereby saving space of storage and transportation.

A further objective of the present invention is to provide a slider with a brake plate, wherein the snow shoveled by a shovel portion of the brake plate is drained outward from a drain hole of the shovel portion. By applying the brake plate to decelerate the sliding speed of the slider, the snow drained outward from the drain hole provides special visual effects to viewers.

In accordance with one embodiment of the present invention, there is a slider, comprising:

a main board movable on a snow ground;

a brake plate mounted on the main board and protruding outward from the main board to face the snow ground, wherein the brake plate is formed with a shovel portion extended toward the snow ground and inserted into the snow ground to provide a braking effect to the main board.

In accordance with another embodiment of the present invention, there is provided a slider, comprising:

a main board movable on a snow ground;

a fixing plate fixed on a surface of the main board facing the snow ground;

a brake plate mounted on the fixing plate and protruding outward from the main board to face the snow ground, wherein the brake plate is formed with a shovel portion extended toward the snow ground and inserted into the snow ground to provide a braking effect to the main board;

a support plate mounted between the fixing plate and the brake plate, so that an included angle is defined between the fixing plate and the brake plate.

Further benefits and advantages of the present invention will become apparent after a careful reading of the detailed description with appropriate reference to the accompanying drawings.

DETAILED DESCRIPTION OF THE INVENTION

Figure 1:
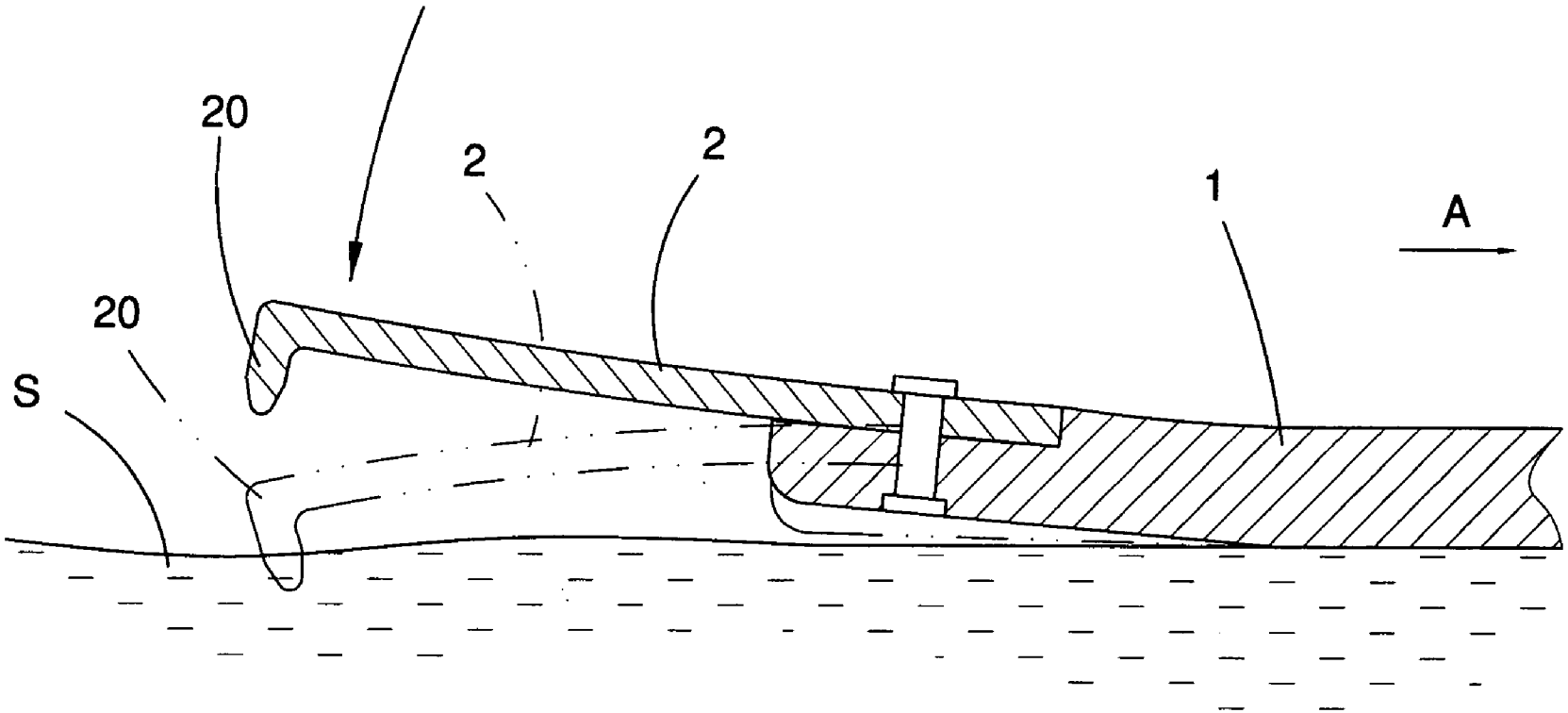
FIG. 1 is a plan cross-sectional view of a slider in accordance with the first preferred embodiment of the present invention.

Referring to the drawings and initially to FIG. 1, a slider in accordance with the first preferred embodiment of the present invention comprises a main board 1, and a brake plate 2. The main board 1 is movable on a snow ground "S" in a travel direction indicated by the arrow "A" and a tail end of the main board 1 facing to the snow ground "S" is raised with an angle. The brake plate 2 is mounted on the tail portion of the main board 1 and protrudes outward from the main board 1 to face the snow ground "S". The brake plate 2 has a distal end formed with a shovel portion 20 extended toward the snow ground "S". In the preferred embodiment of the present invention, the shovel portion 20 of the brake plate 2 is a protruding plate having a face directed toward the travel direction "A" of the main board 1.

When in use, the brake plate 2 is pressed toward the snow ground "S", so that the shovel portion 20 of the brake plate 2 is inserted into the snow ground "S" as shown in phantom lines, thereby forming a resistance so as to brake movement of the main board 1. In practice, when the user is seated on the main board 1, the user only needs to shift the center of gravity backward to press the brake plate 2 so as to produce the braking effect, thereby facilitating the user operating the brake plate 2 to brake the main board 1. Alternatively, the user could also lean back his/her body to have the brake plate 2 pressed so as to provide the braking effect. Thus, the user can operate the brake plate 2 to brake the main board 1 easily and conveniently.

Figure 2:
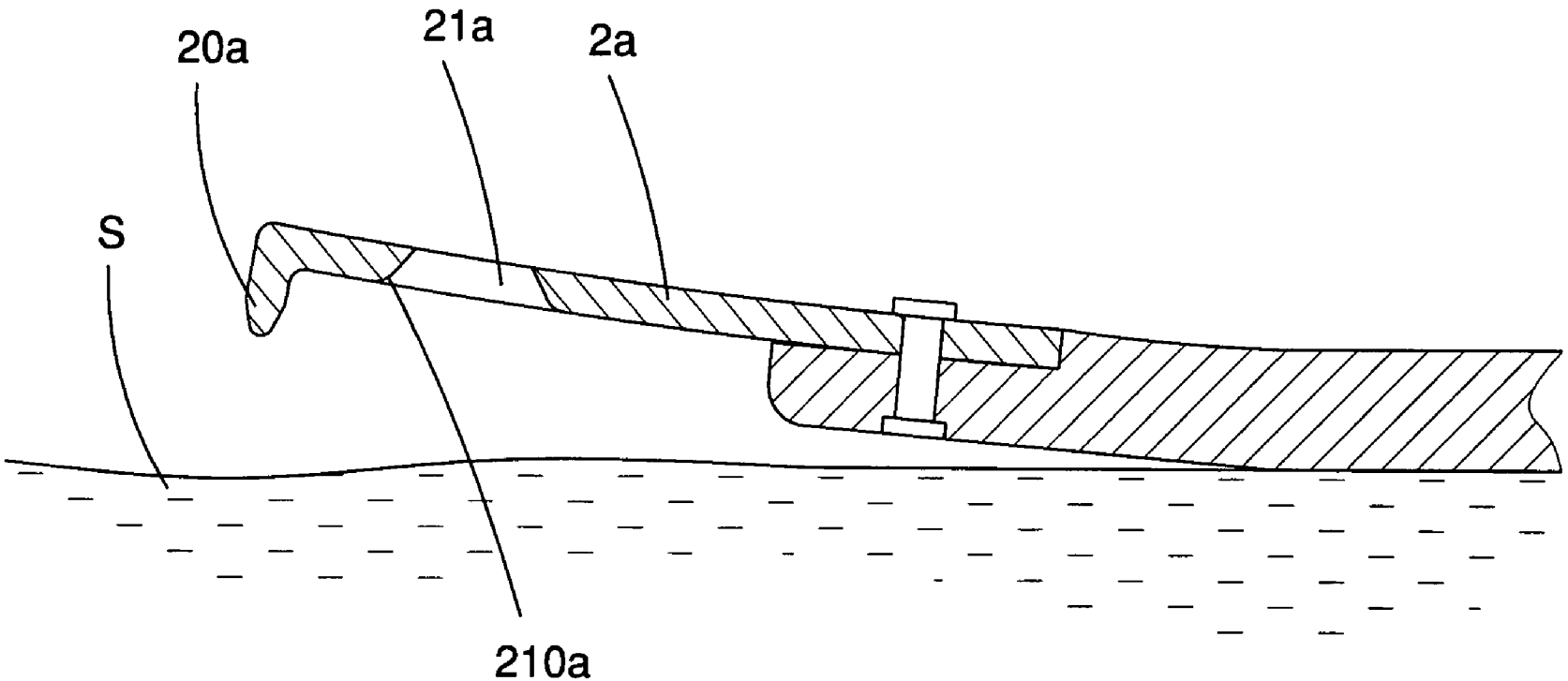
FIG. 2 is a plan cross-sectional view of a slider in accordance with an example of the first preferred embodiment of the present invention.

As shown in FIG. 2, the brake plate 2*a* has a distal end formed with a shovel portion 20*a* and has a portion formed with at least one drain hole 21*a* located adjacent to the shovel portion 20*a* to drain the snow shoveled by the shovel portion 20*a*. The brake plate 2*a* has a surface formed with a first guide face 210*a* enclosed around and smoothly connected to the drain hole 21*a* to guide the snow shoveled by the shovel portion 20*a* to pass through the drain hole 21*a*.

Figure 3:
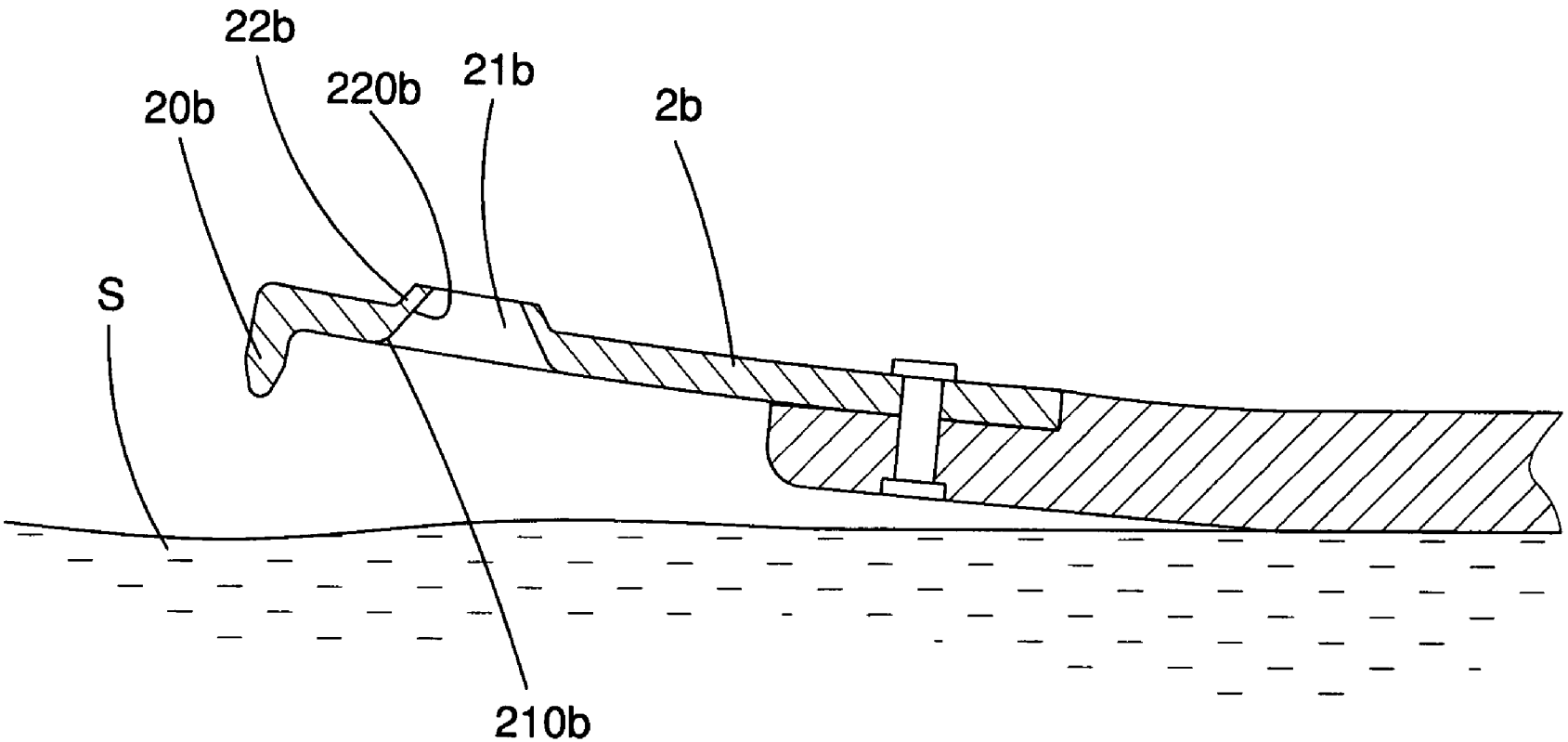
FIG. 3 is a plan cross-sectional view of a slider in accordance with another example of the first preferred embodiment of the present invention.

As shown in FIG. 3, the brake plate 2*b* has a distal end formed with a shovel portion 20*b* and has a portion formed with at least one drain hole 21*b* located adjacent to the shovel portion 20*b* to drain the snow shoveled by the shovel portion 20*b*. The brake plate 2*b* has a first surface formed with a first guide face 210*b* enclosed around and smoothly connected to the drain hole 21*b* to guide the snow shoveled by the shovel portion 20*b* to pass through the drain hole 21*b*. The brake plate 2*b* has a second surface formed with a peripheral wall 22*b* enclosed around the drain hole 21*b*. The peripheral wall 22*b* of the brake plate 2*b* has an inside formed with a second guide face 220*b* smoothly connected to the first guide face 210*b* to guide the snow shoveled by the shovel portion 20*b* to drain outward from the peripheral wall 22*b*.

Figure 4:
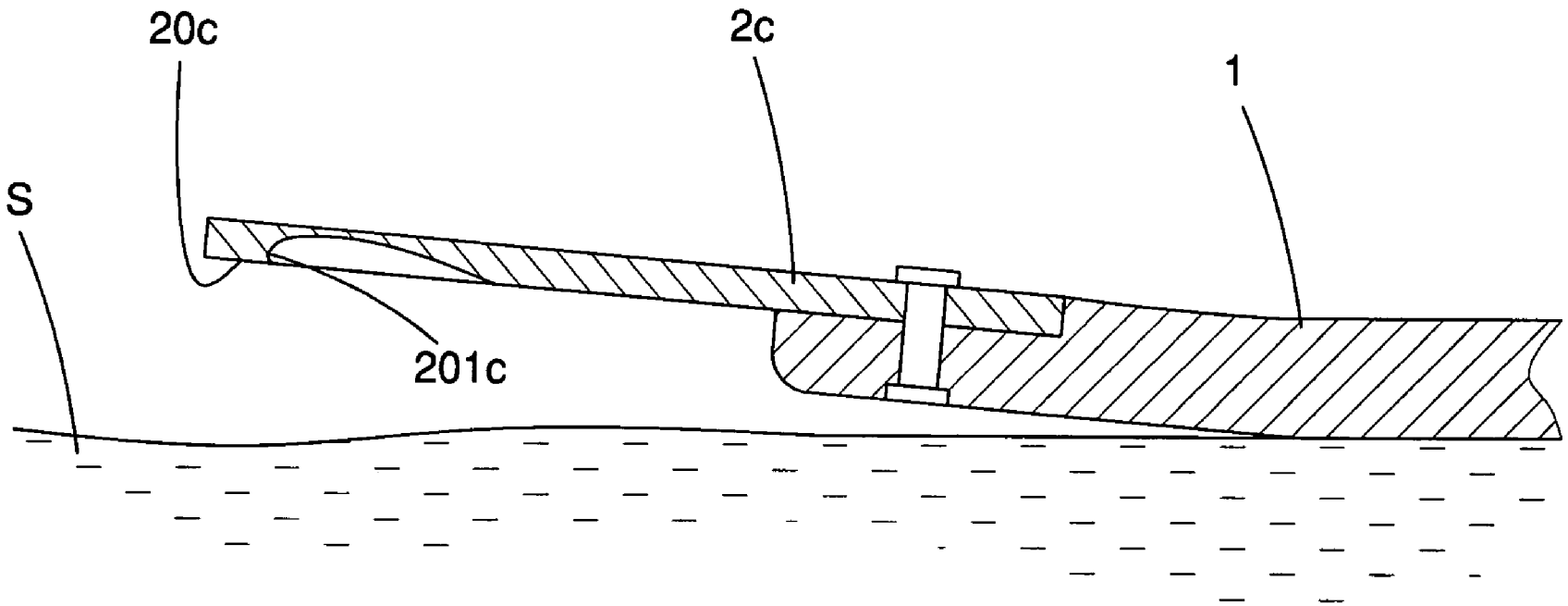
FIG. 4 is a plan cross-sectional view of a slider in accordance with another example of the first preferred embodiment of the present invention.

As shown in FIG. 4, the brake plate 2*c* has a distal end formed with a shovel portion 20*c* and has a surface formed with a recessed wall 201*c* located adjacent to the shovel portion 20*c*. The recessed wall 201*c* of the brake plate 2*c* faces the snow ground "S" and is directed toward the travel direction "A" of the main board 1, so that the recessed wall 201*c* of the brake plate 2*c* is inserted into the snow ground "S" so as to provide the braking effect.

Figure 5:
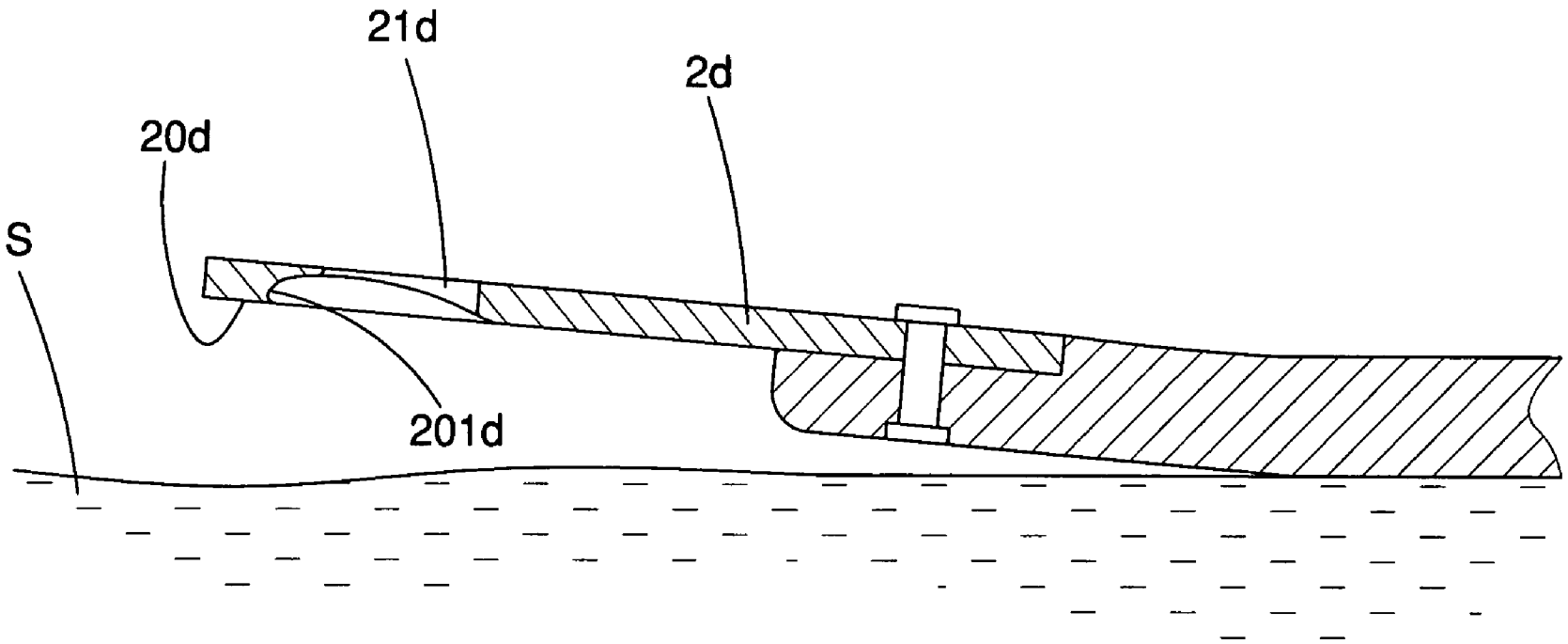
FIG. 5 is a plan cross-sectional view of a slider in accordance with another example of the first preferred embodiment of the present invention.

As shown in FIG. 5, the brake plate 2*d* has a distal end formed with a shovel portion 20*d* and has a surface formed with a recessed wall 201*d* located adjacent to the shovel portion 20*d*. The recessed wall 201*d* of the brake plate 2*d* is formed with at least one drain hole 21*d* to drain the snow shoveled by the shovel portion 20*d*.

Figure 6:
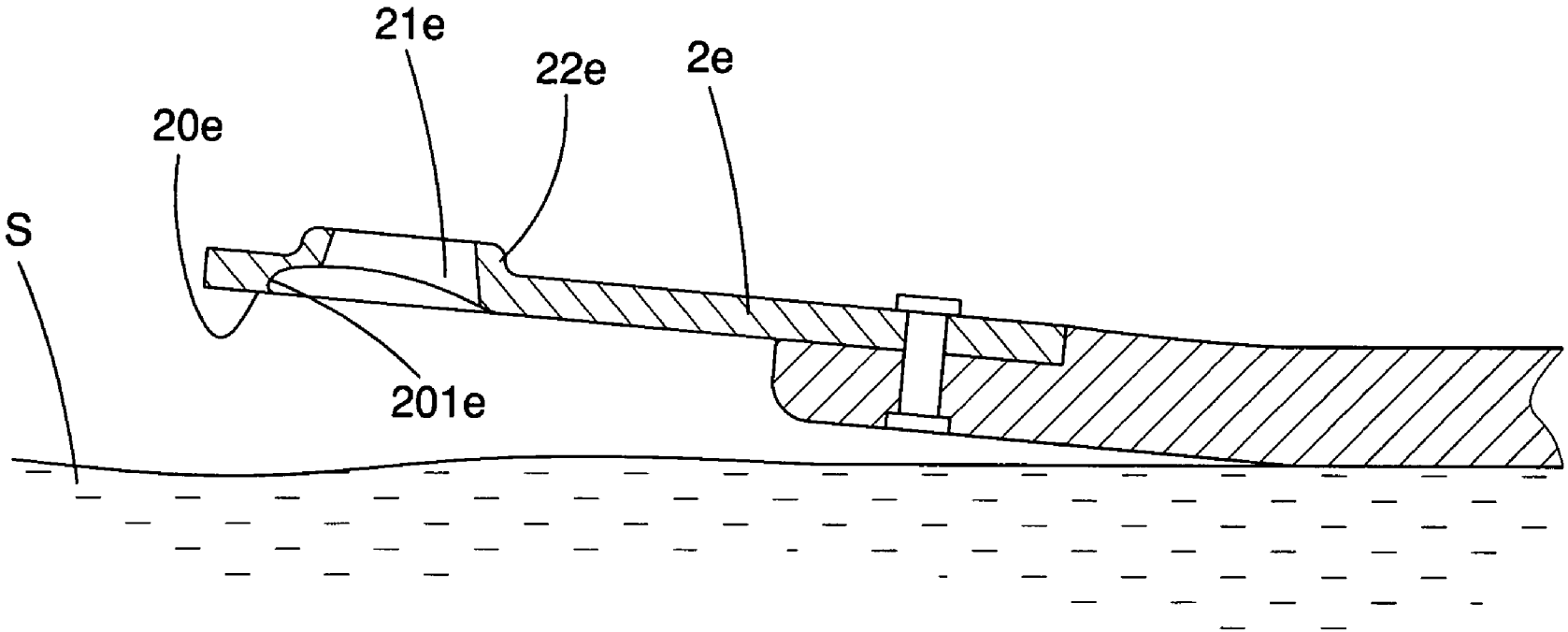
FIG. 6 is a plan cross-sectional view of a slider in accordance with another example of the first preferred embodiment of the present invention.

As shown in FIG. 6, the brake plate 2*e* has a distal end formed with a shovel portion 20*e* and has a first surface formed with a recessed wall 201*e* located adjacent to the shovel portion 20*e*. The recessed wall 201*e* of the brake plate 2*e* is formed with at least one drain hole 21*e* to drain the snow shoveled by the shovel portion 20*e*. The brake plate 2*e* has a second surface formed with a peripheral wall 22*e* enclosed around the drain hole 21*e* to guide the snow shoveled by the shovel portion 20*d*.

Figure 7:
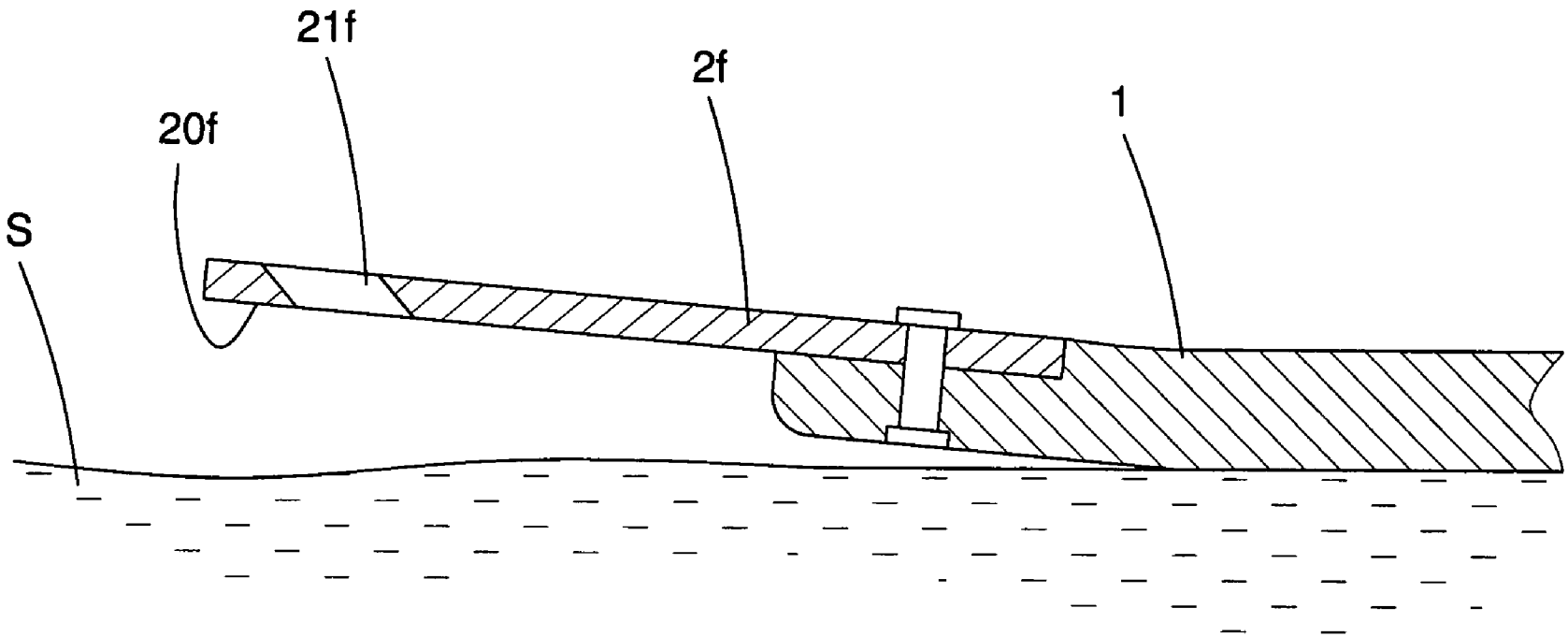
FIG. 7 is a plan cross-sectional view of a slider in accordance with another example of the first preferred embodiment of the present invention.

As shown in FIG. 7, the brake plate 2*f* has a distal end formed with a shovel portion 20*f* and has a portion formed with at least one drain hole 21*f* located adjacent to the shovel portion 20*f* to drain the snow shoveled by the shovel portion 20*f*. The drain hole 21*f* is an oblique hole corresponding to the travel direction of the main board 1 so as to guide the snow shoveled by the shovel portion 20*f*.

Figure 8:
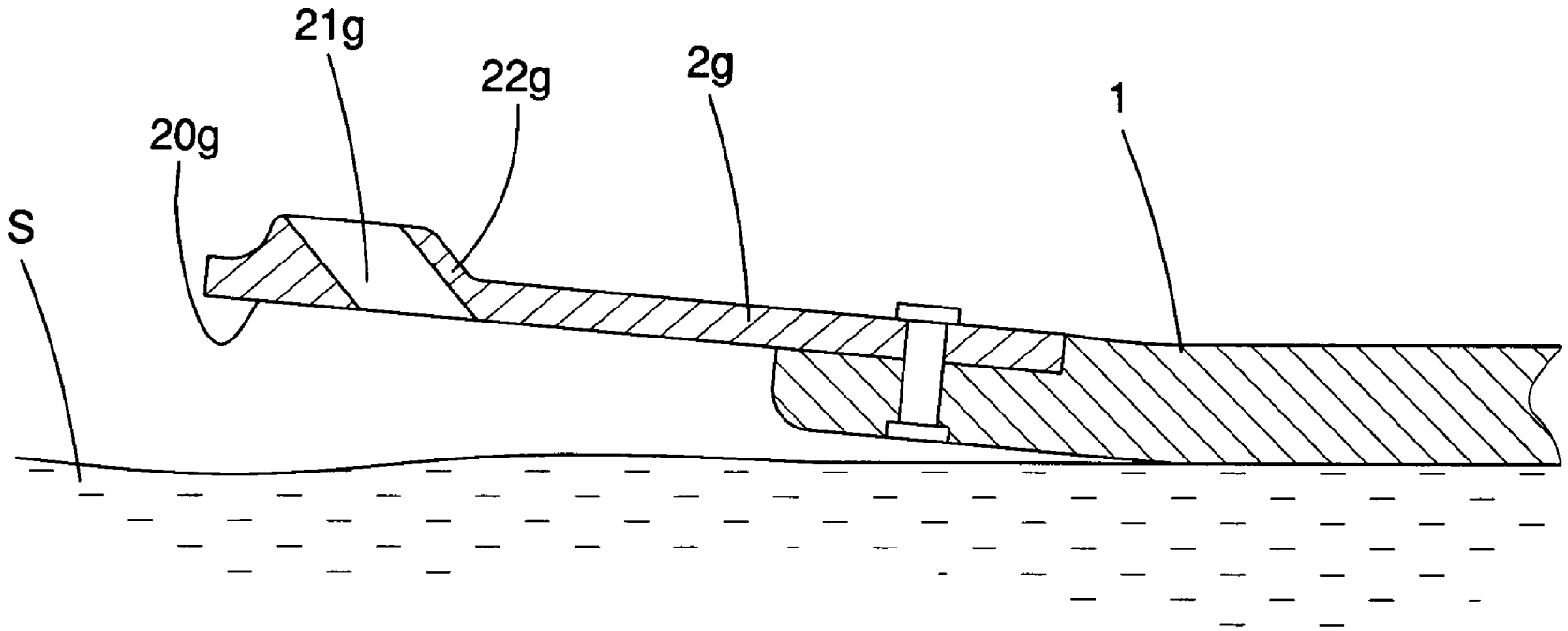
FIG. 8 is a plan cross-sectional view of a slider in accordance with another example of the first preferred embodiment of the present invention.

As shown in FIG. 8, the brake plate 2*g* has a distal end formed with a shovel portion 20*g* and has a portion formed with at least one drain hole 21*g* located adjacent to the shovel portion 20*g* to drain the snow shoveled by the shovel portion 20*g*. The drain hole 21*g* is an oblique hole corresponding to the travel direction of the main board 1 so as to guide the snow shoveled by the shovel portion 20*g*. The brake plate 2*g* has a surface located opposite to the snow ground "S" and formed with a peripheral wall 22*g* enclosed around the drain hole 21*g* to guide the snow shoveled by the shovel portion 20*g*.

Referring to FIGS. 9–14, a slider in accordance with the second preferred embodiment of the present invention comprises a main board 3, a fixing plate 4, a brake plate 5, and a support plate 6. The main board 3 is movable on the snow ground "S" and a tail end of the main board 3 facing to the snow ground "S" is raised with an angle. The fixing plate 4 is fixed on the tail end of the main board 3 facing the snow ground "S" and the brake plate 5 is attached to the main board 3 by the fixing plate 4. The fixing plate 4 has a surface facing the snow ground "S" and formed with a first fixing recess 40 and a second fixing recess 41. The brake plate 5 is partially fixed in the first fixing recess 40 of the fixing plate 4 and partially extended outward from the main board 3 to face the snow ground "S". The brake plate 5 has a first surface facing the snow ground "S" and formed with a shovel portion 50 that is inserted into the snow ground "S" so as to provide a braking effect. The support plate 6 is mounted between the fixing plate 4 and the brake plate 5, so that an included angle is defined between the fixing plate 4 and the brake plate 5. In the preferred embodiment of the present invention, the support plate 6 has one end pivotally mounted on a second surface of the brake plate 5 facing the fixing plate 4 and the other end inserted into the second fixing recess 41 of the fixing plate 4.

Figure 9:
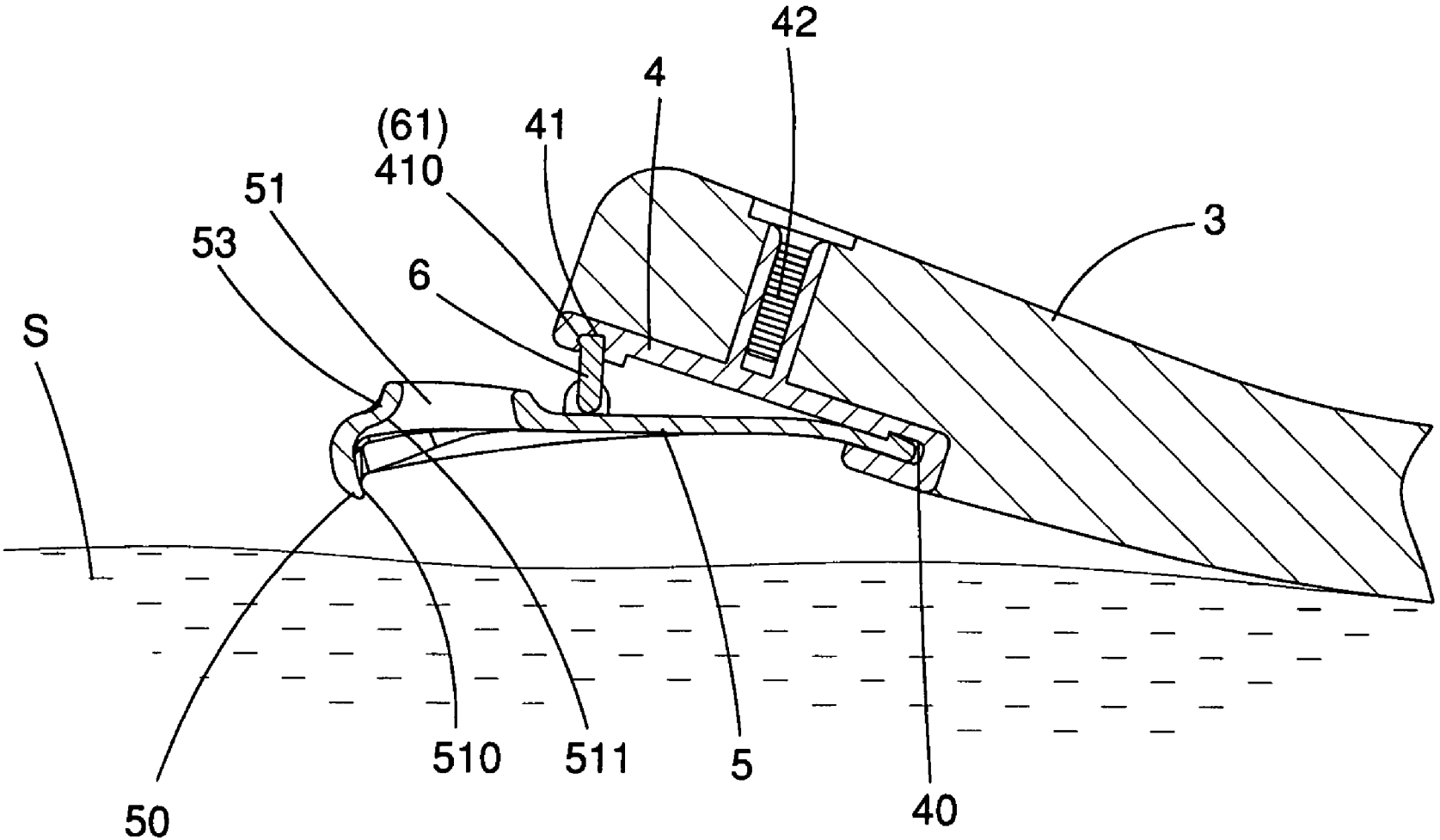
FIG. 9 is a plan cross-sectional view of a slider in accordance with the second preferred embodiment of the present invention.
Figure 10:
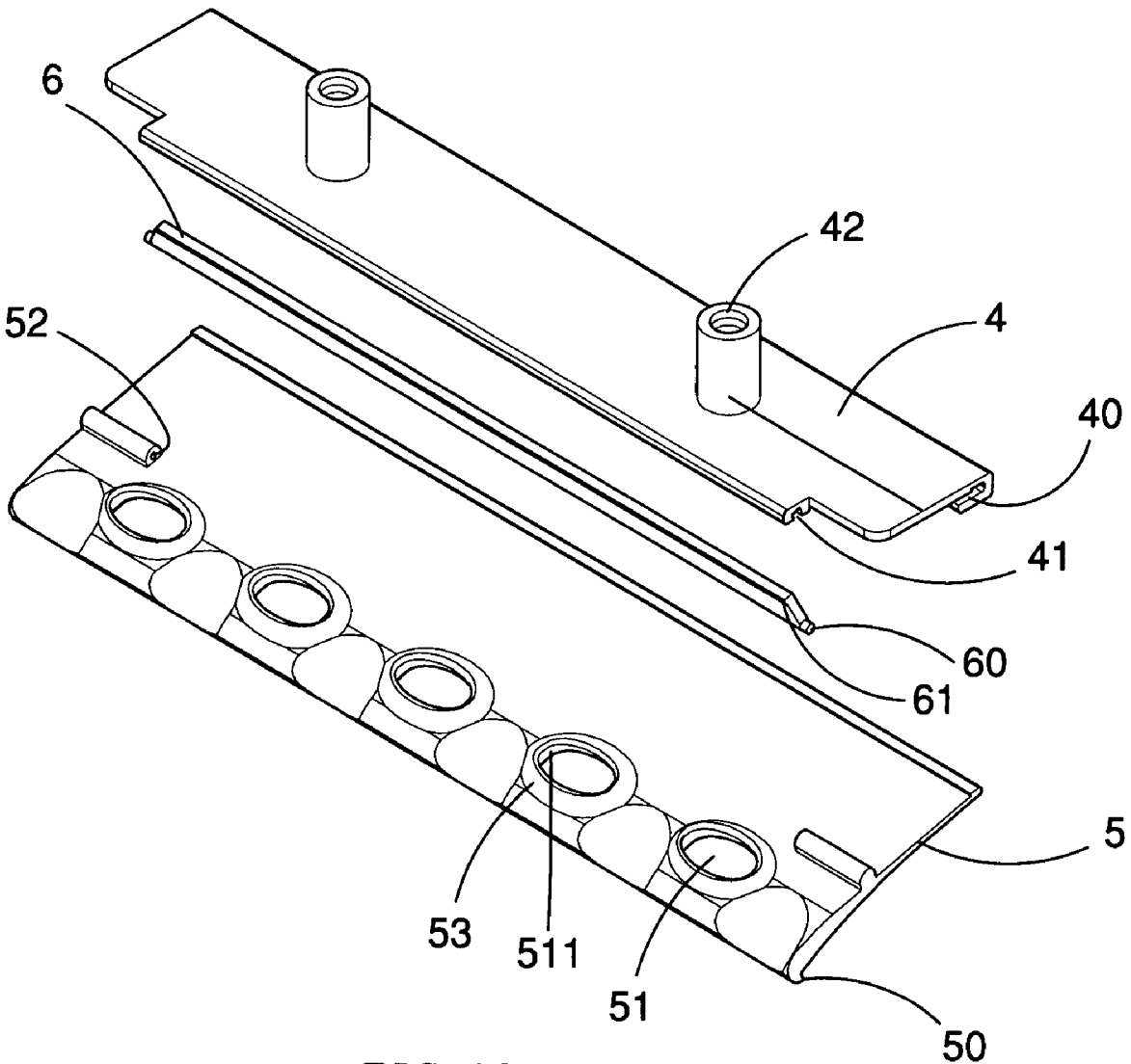
FIG. 10 is a partially exploded perspective view of the fixing plate, the brake plate and the support plate as shown in FIG. 9.
Figure 11:
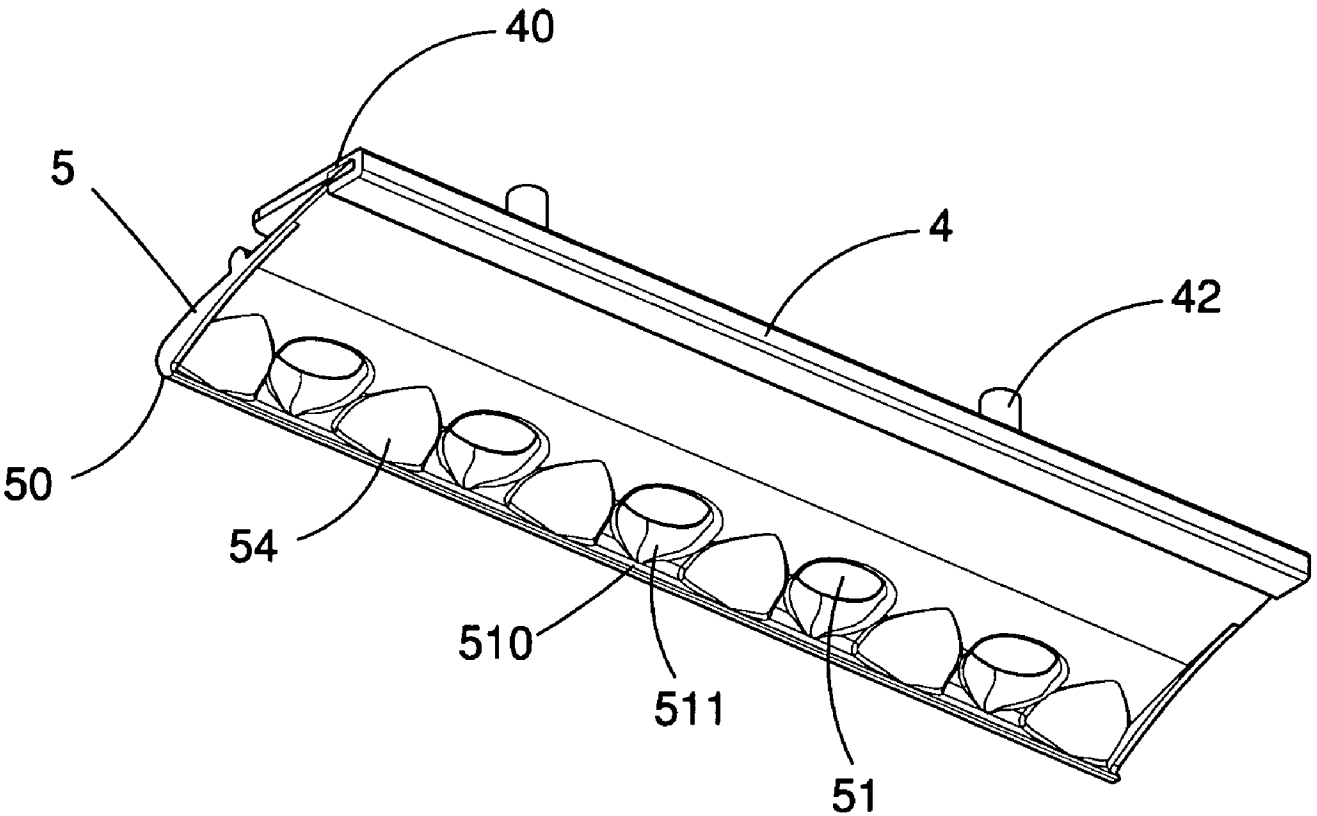
FIG. 11 is a bottom perspective assembly view of the fixing plate and the brake plate as shown in FIG. 10.

As shown in FIGS. 9–11, the fixing plate 4 has a top provided with a plurality of fixing receptors 42, such as bolts or snap rivets for fixing the fixing plate 4 to the main board 3. The shovel portion 50 of the brake plate 5 is extended toward the snow ground "S". In the preferred embodiment of the present invention, the shovel portion 50 of the brake plate 5 is a protruding plate having a face directed toward the travel direction of the main board 1. The brake plate 5 has a portion formed with at least one drain hole 51 located adjacent to the shovel portion 50 to drain the snow shoveled by the shovel portion 50. The first surface of the brake plate 5 is formed with a first guide face 510 enclosed around and smoothly connected to the drain hole 51 to guide the snow shoveled by the shovel portion 50 to pass through the drain hole 51. The second surface of the brake plate 5 is formed with a peripheral wall 53 enclosed around the drain hole 51. The peripheral wall 53 of the brake plate 5 has an inside formed with a second guide face 511 smoothly connected to the first guide face 510 to guide the snow shoveled by the shovel portion 50 to drain outward from the peripheral wall 53.

As shown in FIG. 11, the first guide face 510 of the brake plate 5 has two opposite sides each formed with a lug 54 that is gradually reduced in the travel direction of the main board 3 to form a conic face to guide the snow shoveled by the shovel portion 50 into the drain hole 51.

As shown in FIGS. 9–12, the second surface of the brake plate 5 is formed with two opposite shaft holes 52 facing the second fixing recess 41 of the fixing plate 4 for mounting the support plate 6. The support plate 6 is pivotally mounted between the two opposite shaft holes 52 of the brake plate 5 and has two ends each provided with a shaft 60 pivotally mounted in one of the two opposite shaft holes 52 of the brake plate 5. The second fixing recess 41 of the fixing plate 4 has a side formed with a locking groove 410, and the support plate 6 has a side provided with a locking flange 61 detachably locked in the locking groove 410 of the second fixing recess 41 of the fixing plate 4.

Figure 12:
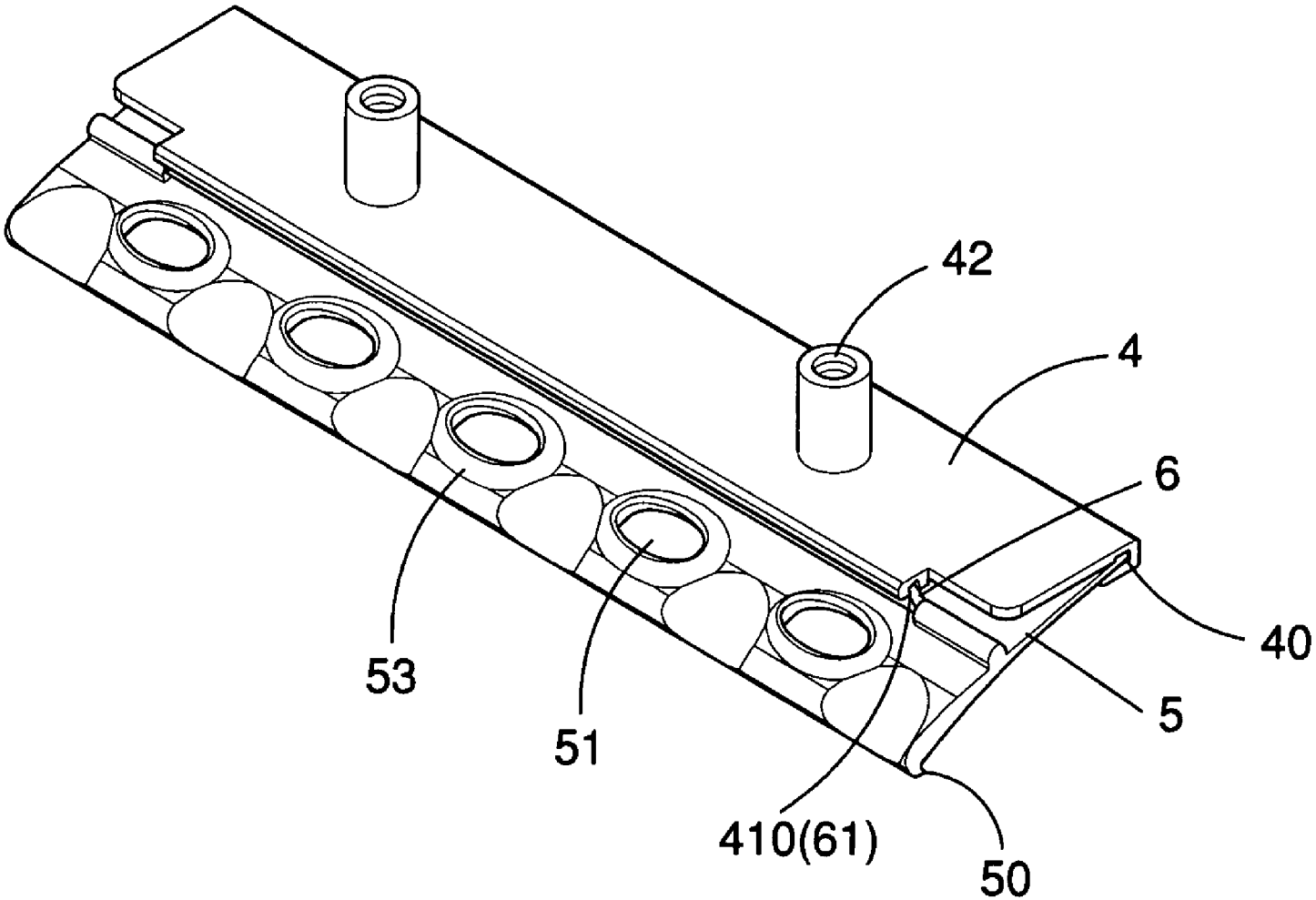
FIG. 12 is a perspective assembly view of the fixing plate, the brake plate and the support plate as shown in FIG. 10.

As shown in FIG. 12, the support plate 6 is pivotally mounted between the two opposite shaft holes 52 of the brake plate 5 by the shafts 60, and the locking flange 61 of the support plate 6 is detachably locked in the locking groove 410 of the second fixing recess 41 of the fixing plate 4, so that the support plate 6 is pivotally mounted on the brake plate 5 and is detachably locked by the fixing plate 4.

Figure 13:
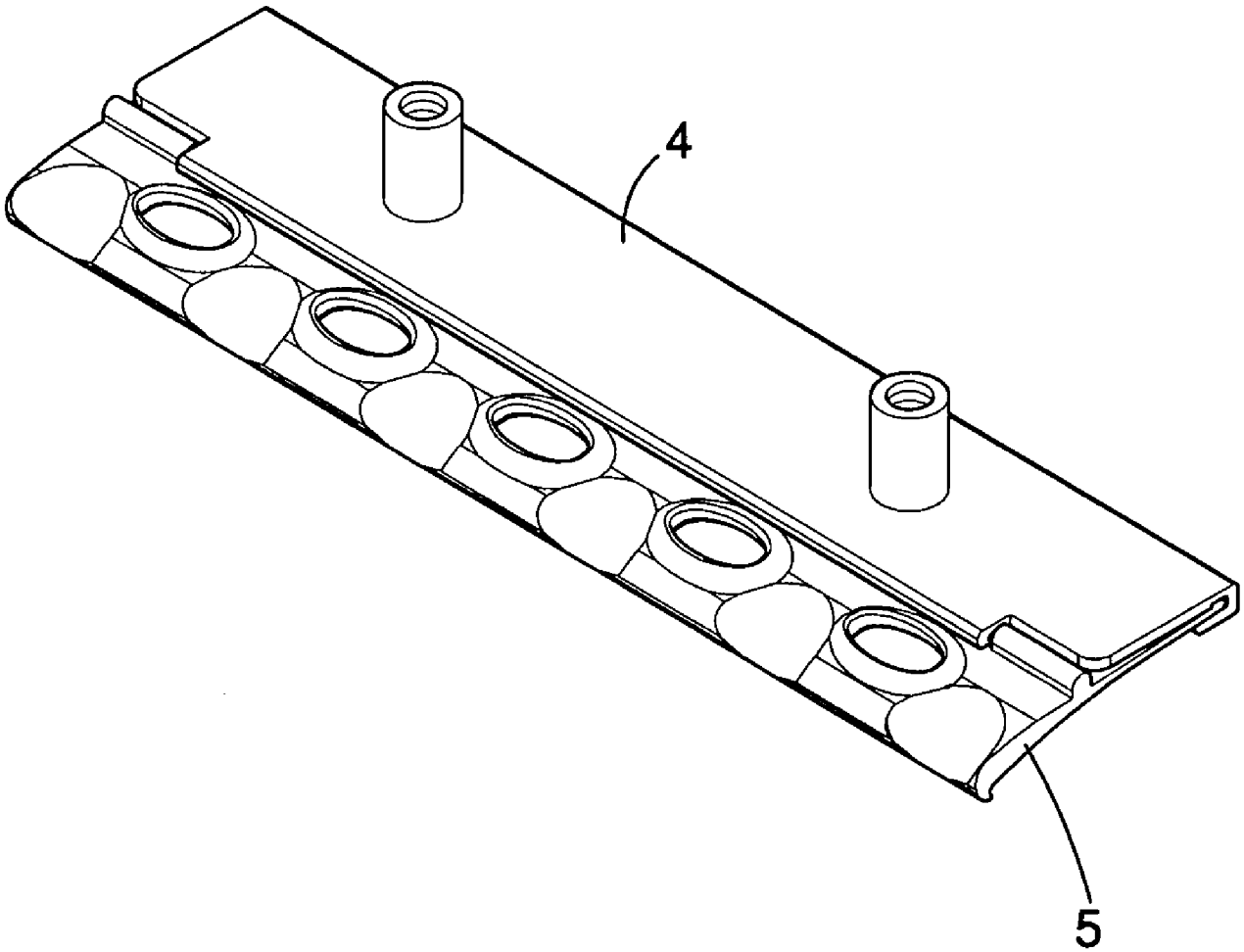
FIG. 13 is a perspective folded view of the fixing plate, the brake plate and the support plate as shown in FIG. 12.

As shown in FIG. 13, the brake plate 5 is made of resilient and flexible material, such as PE having a lower density. Thus, the locking flange 61 of the support plate 6 is pushed to detach from the locking groove 410 of the second fixing recess 41 of the fixing plate 4 to release the support plate 6 from the fixing plate 4, so that the support plate 6 is pivoted relative to and rested on the brake plate 5, thereby folding the brake plate 5 on the main board 3. Thus, the slider is portable and has a smaller folded volume, thereby saving space of storage and transportation.

Figure 14:
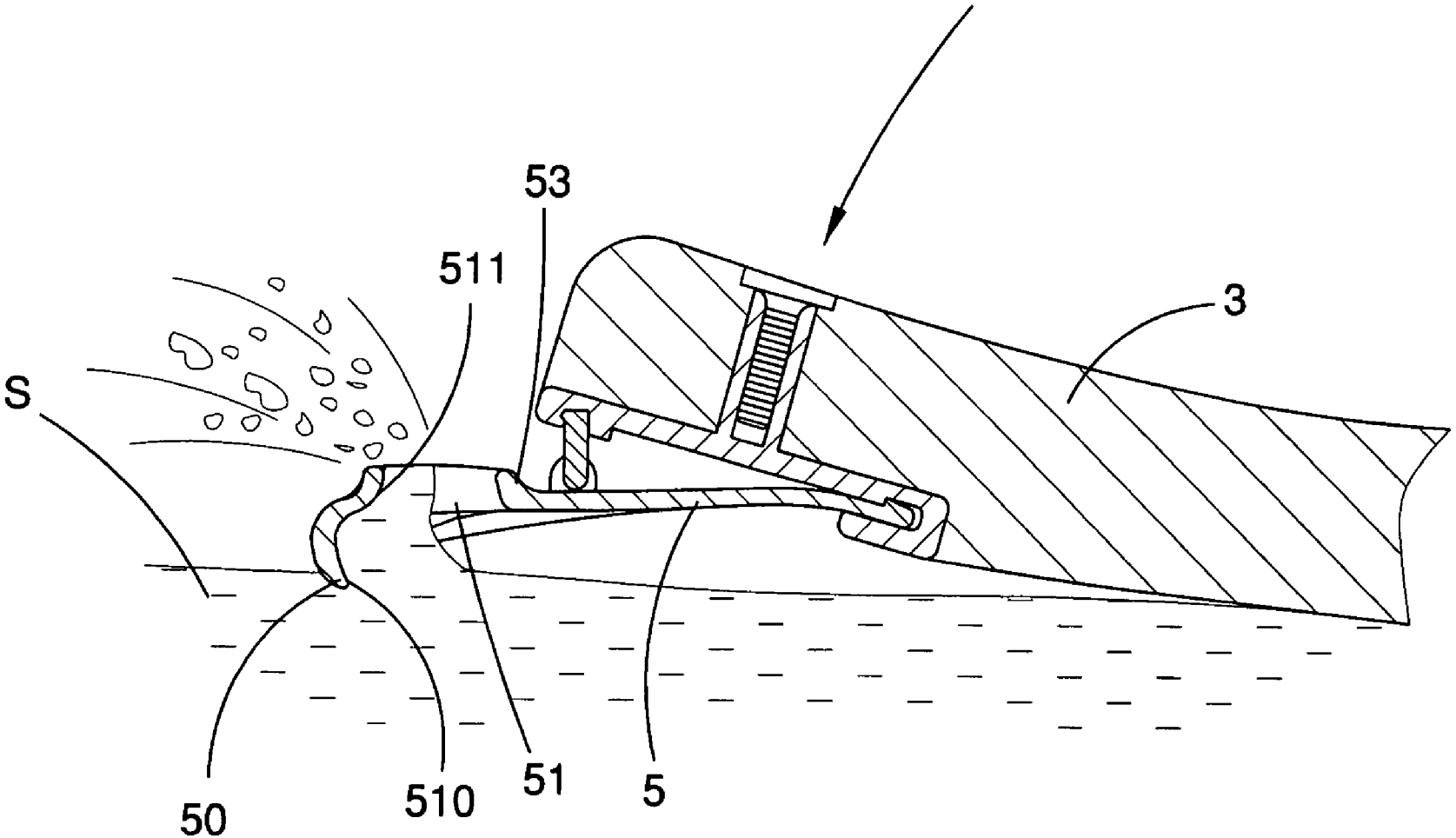
FIG. 14 is a schematic operational view of the slider as shown in FIG. 9 in use.

As shown in FIG. 14, when in use, the brake plate 5 is pressed toward the snow ground "S", so that the shovel portion 50 of the brake plate 5 is inserted into the snow ground "S", thereby forming a resistance so as to brake movement of the main board 3. In practice, when the user is seated on the main board 3, the user only needs to shift the center of gravity backward to press the brake plate 5 so as to produce the braking effect, thereby facilitating the user operating the brake plate 5 to brake the main board 3. Alternatively, the user could also lean back his/her body to have the brake plate 5 pressed so as to provide the braking effect. Thus, the user can operate the brake plate 5 to brake the main board 3 easily and conveniently. In addition, the snow shoveled by the shovel portion 50 of the brake plate 5 is drained outward from the drain hole 51 by provision of the first guide face 510, the second guide face 511, the peripheral wall 53 and the lug 54.

Figure 15:
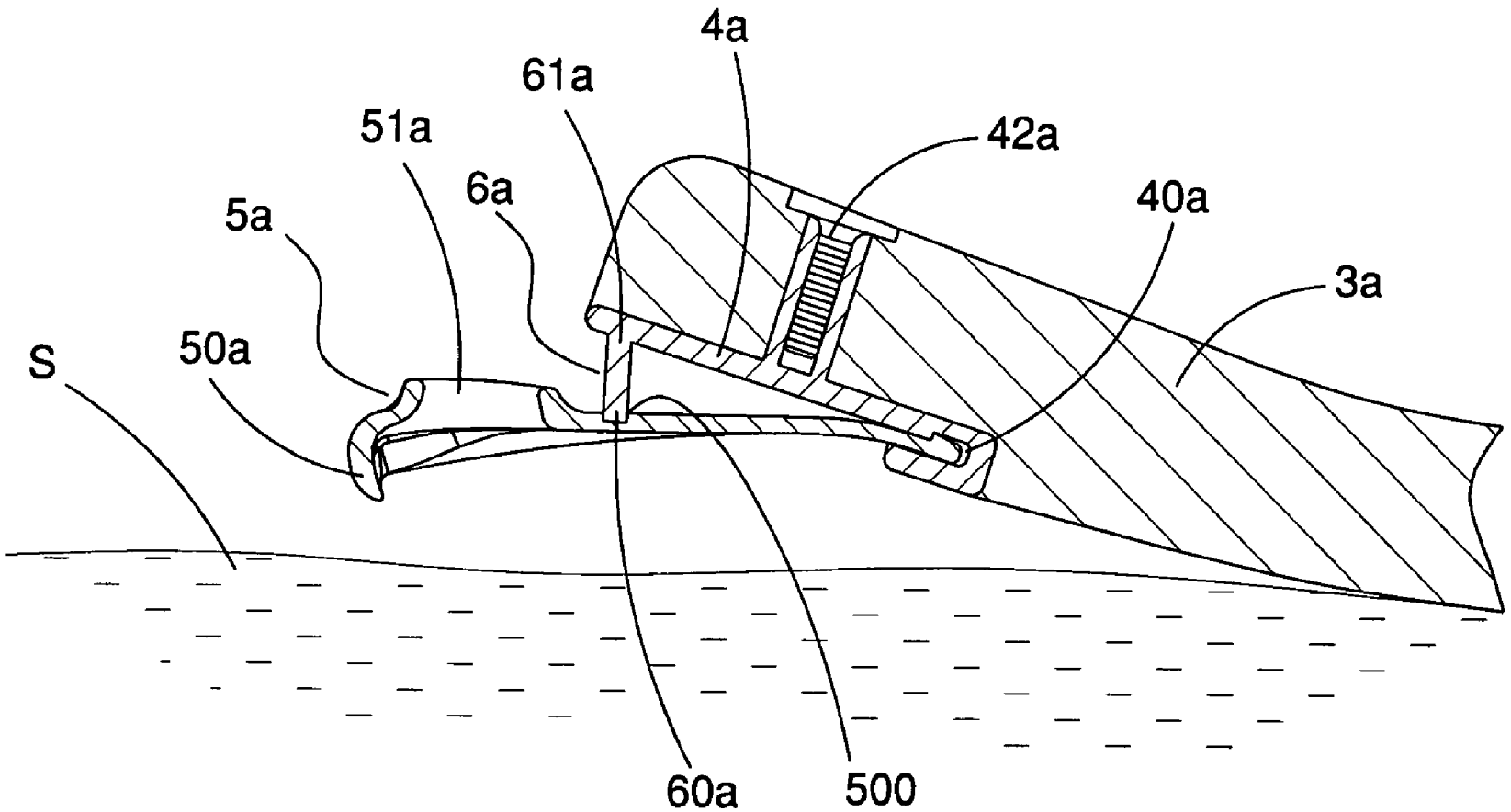
FIG. 15 is a plan cross-sectional view of a slider in accordance with the third preferred embodiment of the present invention.
Figure 16:
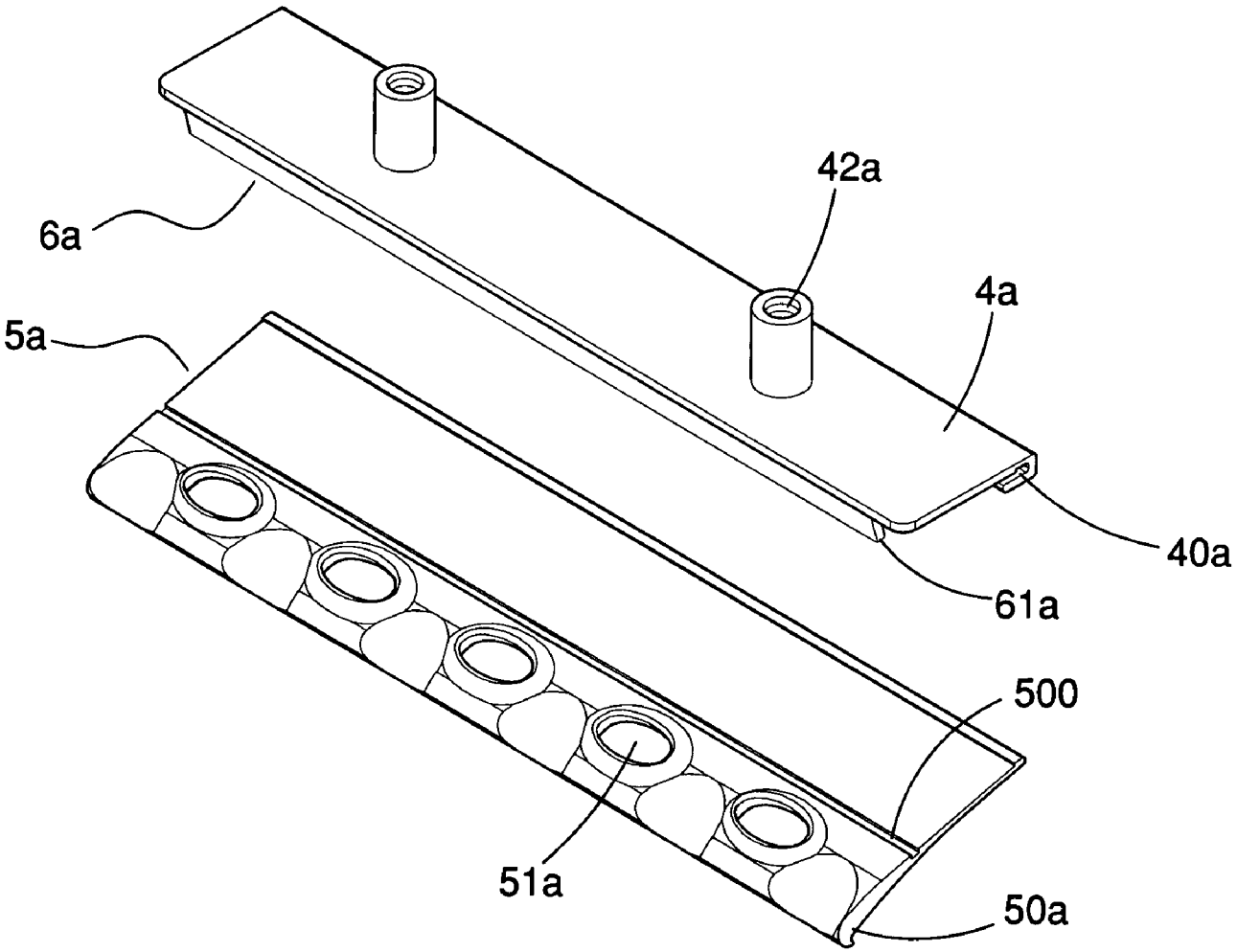
FIG. 16 is a partially exploded perspective view of the fixing plate, the brake plate and the support plate as shown in FIG. 15.

FIGS. 15–16 show a third preferred embodiment of the present invention that comprises a main board 3*a*, a fixing plate 4*a*, a brake plate 5*a*, and a support plate 6*a*.

Similarly to the second preferred embodiment, the main board 3*a* of the third preferred embodiment has a tail end facing to the snow ground "S" and the tail end of the main board 3*a* is raised with an angle. The fixing plate 4*a* is fixed on the tail end of the main board 3*a* facing the snow ground "S" and the brake plate 5*a* is attached to the main board 3*a* by the fixing plate 4*a*. Furthermore, the fixing plate 4*a* is fixed to the main board 3*a* by a plurality of fixing receptors 42*a*, such as bolts or snap rivets. The brake plate 5*a* has a shovel portion 50*a* and drain holes 51*a*. Because the structures of the shovel portion 50*a* and the drain holes 51*a* are the same as the second preferred embodiment, the detail descriptions of the shovel portion 50*a* and the drain holes 51*a* are omitted.

Differently from the second preferred embodiment, the fixing plate 4*a* of the third preferred embodiment has a surface facing the snow ground "S" and formed with a first fixing recess 40*a*. In addition, the brake plate 5*a* of the third preferred embodiment is partially fixed in the first fixing recess 40*a* of the fixing plate 4*a* and the brake plate 5*a* has a surface facing the fixing plate 4*a* formed with a second fixing recess 500. The support plate 6*a* has one end 61*a* integrated with the surface of the fixing plate 4*a* and the other end 60*a* fixed in the second fixing recess 500 of the brake plate 5*a*.

According to the descriptions of the second and the third preferred embodiments, the connections between the fixing plate 4*a*, the brake plate 5*a* and the support plate 6*a* could be optional by other techniques.

Accordingly, the user only needs to press the brake plate toward the snow ground to insert the shove portion into the snow ground to produce a resistance, thereby providing a braking effect. In addition, the user can operate the brake plate to brake the main board easily and conveniently, thereby facilitating the user in braking the main board. Further, the slider is portable and has a smaller folded volume, thereby saving space of storage and transportation. Further, the snow shoveled by the shovel portion of the brake plate is drained outward from the drain hole. By applying the brake plate to decelerate the sliding speed of the slider, the snow drained outward from the drain hole provides special visual effects to viewers.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A slider comprising:

a main board movable on a snow ground;

a fixing plate fixed on a surface of the main board facing the snow ground;

a brake plate mounted on the fixing plate and protruding outward from the main board to face the snow ground, wherein brake plate is formed with a shovel portion extended toward the snow ground and inserted into the snow ground to provide a braking effect to the main board, and the shovel portion of the brake plate including a protruding plate protruding therefrom and having a face directed toward a travel direction of the main board, and wherein the brake plate has a portion formed with at least one drain hole located adjacent to the shovel portion to drain the snow shoveled by the shovel portion, and has a surface facing the snow ground and formed with a first guide face enclosed around and smoothly connected to the drain hole to guide the snow shoveled by the shovel portion to pass through the drain hole and wherein the first guide face of the brake plate has two opposite sides each formed with a lug that is gradually reduced in the travel direction of the main board to form a conic face to guide the snow shoveled by the shovel portion into the drain hole; and a support plate mounted between the fixing plate and the brake plate, so that an included angle is defined between the fixing plate and the brake plate.

2. A slider, comprising:

a main board movable on a snow ground;

a fixing plate fixed on a surface of the main board facing the snow ground;

a brake plate mounted on the fixing plate and protruding outward from the main board to face the snow ground, wherein the brake plate is formed with a shovel portion extended toward the snow ground and inserted into the snow ground to provide a braking effect to the main board, and the shovel portion of the brake plate including a protruding plate protruding therefrom and having a face directed toward a travel direction of the main board, and wherein the brake plate has a portion formed with at least one drain hole located adjacent to the shovel portion to drain the snow shoveled by the shovel portion and has a surface facing the snow ground and formed with a first guide face enclosed around and smoothly connected to the drain hole to guide the snow shoveled by the shovel portion to pass through the drain hole, and wherein the brake plate has a second surface located opposite to the first guide face and formed with a peripheral wall enclosed around the drain hole, and the peripheral wall of the brake plate has an inside formed with a second guide face smoothly connected to the first guide face to guide the snow shoveled by the shovel portion to drain outward from the peripheral wall, and wherein the first guide face of the brake plate has two opposite sides each formed with a lug that is gradually reduced in the travel direction of the main board to form a conic face to guide the snow shoveled by the shovel portion into the drain hole; and a support plate mounted between the fixing plate and the brake plate, so that an included angle is defined between the fixing plate and the brake plate.

3. A slider, comprising:

a main board movable on a snow ground;

a fixing plate fixed on a surface of the main board facing the snow ground;

a brake plate mounted on the fixing plate and protruding outward from the main board to face the snow ground, wherein the brake plate is formed with a shovel portion extended toward the snow ground and inserted into the snow ground to provide a braking effect to the main board; and a support plate mounted between the fixing plate and the brake plate so that an included angle is defined between the fixing plate and the brake plate, and wherein:

the fixing plate has a surface facing the snow ground and formed with a first fixing recess;

the brake plate is partially fixed in the first fixing recess of the fixing plate, wherein the brake plate has a surface facing the fixing plate and formed with a second fixing recess; and the support plate has one end integrated with the surface of the fixing plate and the other end fixed in the second fixing recess of the brake plate.

4. The slider in accordance with claim 3, wherein the brake plate has a portion formed with at least one drain hole located adjacent to the shovel portion to drain the snow shoveled by the shovel portion.

* * * * *